US007412066B2

(12) United States Patent
Muren et al.

(10) Patent No.: US 7,412,066 B2
(45) Date of Patent: Aug. 12, 2008

(54) MICROPHONE

(75) Inventors: Peter Muren, Nesbru (NO); Trygve Frederik Marton, Oslo (NO)

(73) Assignee: Tandberg Telecom AS, Lysaker (NO)

( * ) Notice: Subject to any disclaimer, the term of this patent is extended or adjusted under 35 U.S.C. 154(b) by 704 days.

(21) Appl. No.: 10/922,793

(22) Filed: Aug. 20, 2004

(65) Prior Publication Data

US 2005/0084121 A1 Apr. 21, 2005

(30) Foreign Application Priority Data

Aug. 25, 2003 (NO) ..... 20033768

(51) Int. Cl.
*H04R 25/00* (2006.01)

(52) U.S. Cl. ..... 381/177; 381/171; 381/421

(58) Field of Classification Search ..... 381/171, 381/176, 177, 191, 361–368, 386–393, 399, 381/421

See application file for complete search history.

(56) References Cited

U.S. PATENT DOCUMENTS

| | | | | |
|---|---|---|---|---|
| 3,428,370 | A | 2/1969 | Steingroever | |
| 3,597,022 | A | 8/1971 | Waldron | |
| 3,983,337 | A | 9/1976 | Babb | |
| 4,199,667 | A | 4/1980 | Renner | |
| 4,504,703 | A * | 3/1985 | Schneiter et al. | 381/191 |
| 4,514,598 | A | 4/1985 | Plice | |
| 4,783,824 | A | 11/1988 | Kobayashi | |
| 4,854,415 | A * | 8/1989 | Goschke | 381/368 |
| 5,007,292 | A | 4/1991 | Crowe et al. | |
| 6,111,972 | A | 8/2000 | Rigondeau | |
| 6,226,386 | B1 | 5/2001 | Akino | |
| 2006/0023902 | A1 * | 2/2006 | Thigpen | 381/191 |

FOREIGN PATENT DOCUMENTS

| | | |
|---|---|---|
| FR | 2 696 308 | 4/1994 |
| NO | 923073 | 8/1992 |

* cited by examiner

*Primary Examiner*—Suhan Ni
(74) *Attorney, Agent, or Firm*—Oblon, Spivak, McClelland, Maier & Neustadt, P.C.

(57) ABSTRACT

A sound recording and/or sound reproducing part loosely anchored/connected to a second part wherein the sound recording and/or sound reproducing part is levitated on a magnetic field. The sound recording and/or sound reproducing part and the second part in combination forms a first sound recording and/or sound reproducing device. The sound recording and/or sound reproducing part can be used within on or more of the following devices; a loud speaking telephone, a telephone, wireless communication equipment, a mobile phone, a Bluetooth device, a videoconference terminal, a hearing aid or active ear protection equipment.

21 Claims, 4 Drawing Sheets

MICROPHONE

RELATED APPLICATION

This application claims priority under 35 U.S.C. § 119 or 365 to Norwegian Application No. 20033768 filed Aug. 25, 2003. The entire teachings of the above application are incorporated herein by reference.

BACKGROUND

Problems caused by feedback either acoustic or structure-borne are a familiar problem within audio, broadcasting or telecommunication.

The response of most microphones is diminished by vibrations picked up from the surrounding structure. In the case of a table microphone, this would be vibrations from the table itself. Someone working on the table may create sounds, knocking, tapping the pencil, moving cups etc., that can find their way to the microphone via vibrations. The airborne sound may also excite the surrounding structure and any resonances in this structure may be coupled to the microphone, resulting in transient and/or harmonic distortion.

In integrated video or telephone conferencing systems, vibrations (sound) from the built in loud speaker, would in addition to going through the air, also go directly to the microphone. That is because the cabinet also starts to vibrate in phase with the loud speaker. In conferences where a table-top microphone is used and particularly where several participants take part in the conference, experience has shown that the participants will be disturbed by noise due to participants that move things on the table or tap on the table with their fingers, a table that often holds the microphone hence you will have, as mentioned above, a coupling between the microphone and in this example the table.

Undesirable coupling between loudspeaker and microphone in teleconference equipment is normally compensated by using an acoustic echo canceller. Such echo cancellers are normally based on a linear model, as the sound propagating through the air is fairly linear. However, vibrations coupled through the cabinet may have larger portions of harmonic distortion, reducing the echo canceller's performance, and may require a more complicated and expensive echo canceller. Also an echo canceller in setups with no or very low mechanical coupling (as in the case of widely separated loudspeaker and microphone) may suffer from such harmonic distortion, as the airborne sound may excite the structure surrounding the microphone.

To increase the performance of the microphone it is therefore essential to mechanically isolate the microphone from the surrounding structure in order to prevent any vibration from entering into the microphone element.

There are many well known techniques addressing the problems of isolating the noise source and the desired signal source. Suppression of unwanted couplings, in particular mechanical couplings, by isolating the sound recording and sound producing source mechanically is one. Traditionally done by e.g. for a record player using floating suspension, traditionally with the use of springs, for microphones and loudspeakers it is known to use elastic suspension for suppression of mechanical coupling. These elastic suspensions can be rubber bands forming the suspension between a microphone or a loudspeaker and its mounting device.

From U.S. Pat. No. 4,199,667 it is known a microphone where the microphone element is mechanically suspended inside a housing. The weight and the properties of the resilient material used to hold the microphone element is known, hence, the natural swinging frequencies is known and this is used to compensate for vibrations that might excite the element. Another way to compensate for the vibration generated noise in the signal is disclosed in U.S. Pat. No. 6,226,386. Here the microphone includes an oscillation-detecting device inside the microphone case. The information from this device is electronically processed and then used to modify the signal from the microphone element in order to compensate for the noise. Yet another way of solving the problem is to actually put the whole microphone case in some kind of flexible cradle, as is done in U.S. Pat. No. 4,514,598.

The problems of vibration are well known by the manufacturers of microphones, therefore these manufacturers have developed microphones that are more, but not completely, immune against vibrations. Lighter/thinner membranes are commonly used, as well as more tension in the membrane. These techniques often have drawbacks, as more expensive production or less sensitivity to airborne sound. In addition, manufacturers recommend rotating the microphone, to avoid vibrations normally (90 degrees) to the membrane. This latter technique only works if there exists a primary "plane" of vibrations.

In other applications, suppression of vibrations is achieved by gyroscopic suspension, fluid filled suspension or magnetic levitation. In the latter case the object that should be isolated from the surrounding structure will be placed on a diamagnetic member levitated relative to permanent magnets. Possible magnetic levitation systems are disclosed in e.g. U.S. Pat. No. 3,428,370 and U.S. Pat. No. 3,597,022.

SUMMARY

The present invention provides a system and the use of such a system that eliminates the drawbacks described above. The invention relates to a new device and use of the device for suppressing acoustic feedback and structure-borne sounds in sound recording and/or sound reproducing parts caused by mechanical or sonic impacts.

In particular, the present invention describes an improved system for a sound recording and/or sound reproducing part wherein the sound recording and/or sound reproducing part is levitated on a magnetic field. The sound recording and/or sound reproducing part may be loosely anchored/connected to a second part. The sound recording and/or sound reproducing part and the second part in combination forms a first sound recording and/or sound reproducing device. The first sound recording and/or sound reproducing device may be an integral part of one or more of the following devices: a loud speaking telephone, a telephone, wireless communication equipment, a mobile phone, a Bluetooth device, a videoconference terminal, a hearing aid and active ear protecting equipment.

According to another aspect, the first sound recording and/or sound reproducing device may form a first layer, in a number of layers wherein each layer is levitated on a magnetic field between an upper and a lower layer.

According to another aspect, the first sound recording and/or sound reproducing device may be fixed sideways through gimbals or flexible pads and/or flexible arms/fingers. The sideways fixing arrangement may comprise one or more arms/fingers stretching out from the first sound recording and/or sound reproducing device with the fixing arrangement fixed to the lower layer. The arms/fingers may be configured to allow the first sound recording and/or sound reproducing device to move freely along an axis parallel to the magnetic flux lines between each layer.

According to another aspect, the magnetic field may be achieved due to a permanent magnet and/or an electromagnet held by the sound recording and/or sound reproducing part and a magnet held by the second part, where the magnets have the same poles facing each other creating a repellent force which causes the sound recording and/or sound reproducing part to levitate.

According to another aspect, the sound recording and/or sound reproducing part may be mechanically secured against mechanically interference, e.g., using a safety bolt and/or a safety hook retention bolt.

In accordance with another aspect, a damping material/substrate may be attached to one or both of the surfaces between the sound recording and/or sound reproducing part and the second part.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The present invention discloses an arrangement and the use of the arrangement where the arrangements main feature is its suppression of all kinds of mechanical couplings between a noise source and a signalling source. In particular it is shown a sound recording and/or sound reproducing part (11, 13, 17 in FIG. 1) loosely anchored/connected to a second part wherein unwanted couplings between the signalling source, i.e., the sound recording and/or sound reproducing part, and the second part is suppressed since the signalling source is levitated on a magnetic field.

The present invention discloses an arrangement where a signalling source, i.e., a microphone is sustained by magnetic levitation in order to suppress structure-borne vibration. In order to make the invention more readily understandable, when reference is made to a microphone, it must be understood that any sound producing or sound recording device can replace the microphone. The performance of the microphone is thereby increased, giving better quality sound and increased ability to pick up low level signals from, e.g., a person placed far away from the microphone.

Further, when reference is made to the loosely anchoring/connection of the microphone to a second member it should be understood that this anchoring/connection can be of any kind known for a person skilled in the art, including wireless connections such as Bluetooth, other radio connections, ultra-violet, magnetically or optical connections for the signal transmission. Further, the power transmission to the floating microphone can be of a wireless type as known from the prior art. The power transmission may include, but is not limited to, inductively coupled systems involving transmission and pickup loops. Typically such an inductively coupled power transmission system utilizes a resonant, quasi square wave, pulse width modulated (PWM) power source for connector less transmission.

Figure 1A:
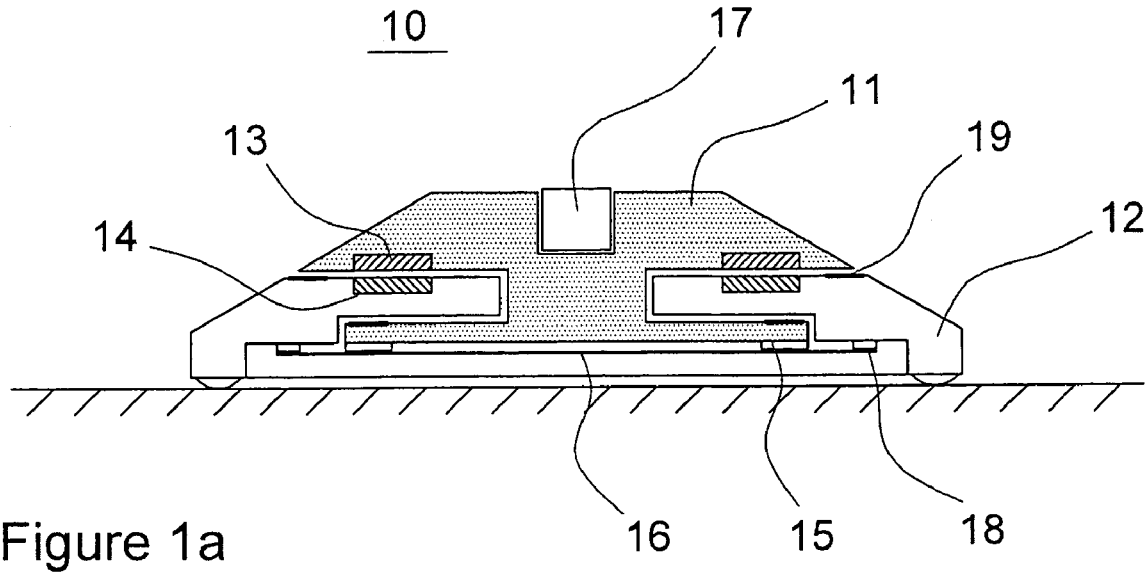
FIGS. 1*a* and 1*b* show a side view and a bottom view, respectively, of the preferred embodiment of the present invention. This is a microphone for use on a conference table.
Figure 1B:
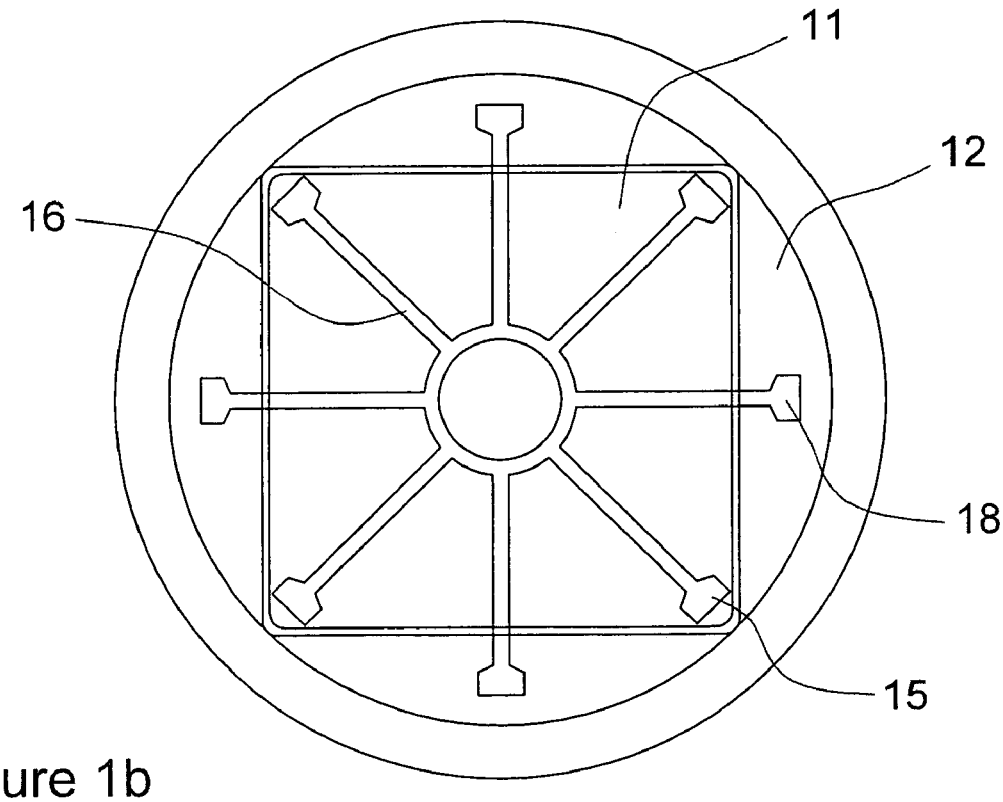
Figure 2A:
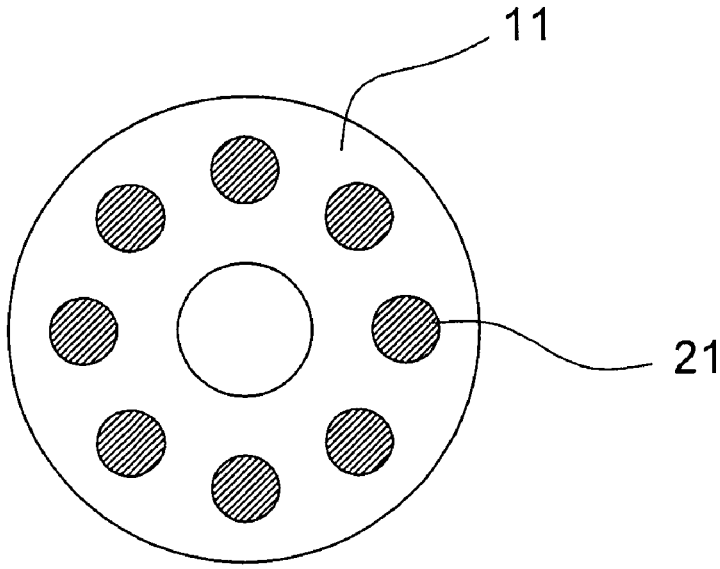
FIGS. 2*a*-2*c* show three different configurations for the magnets used in the microphone of FIGS. 1*a* and 1*b*.
Figure 2B:
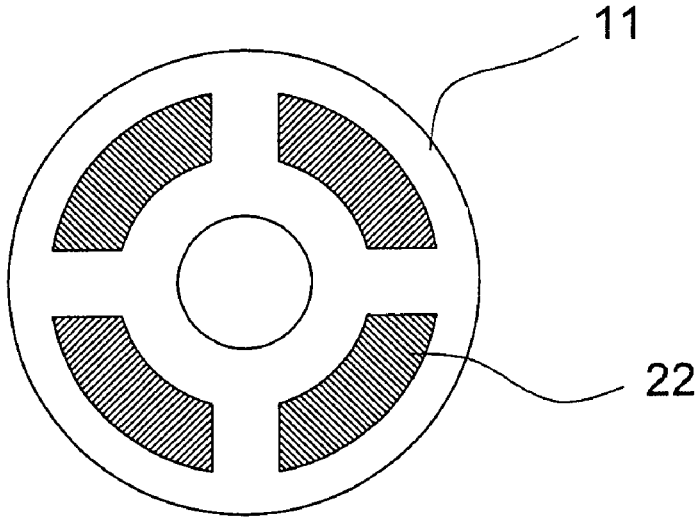
Figure 2C:
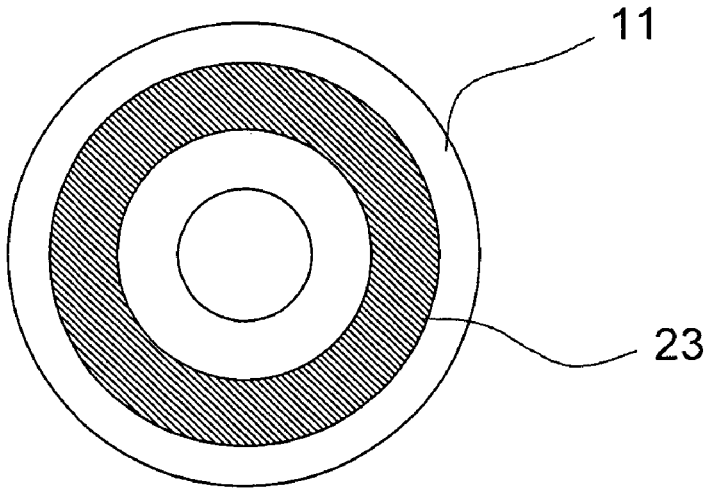
Figure 3:
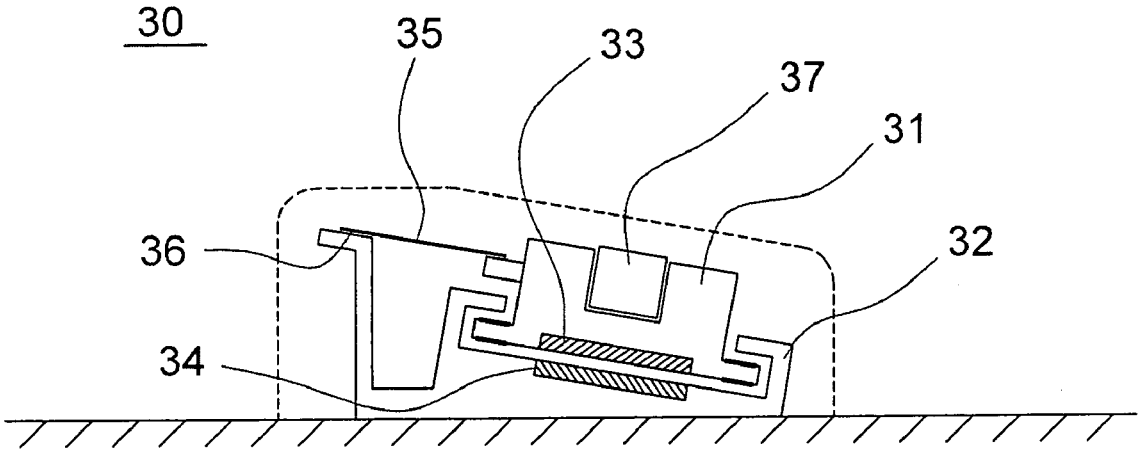
FIG. 3 shows a side view of an alternative embodiment, realized in a microphone intended for building into a cabinet i.e. a loud speaking phone.
Figure 4:
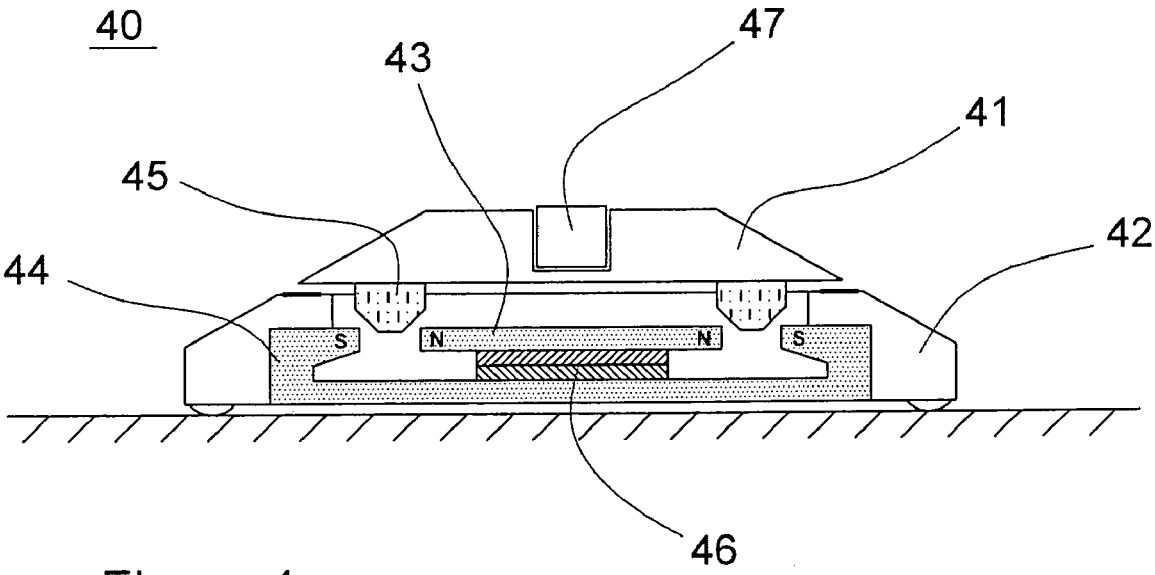
FIG. 4 shows a side view of a microphone placed on a circular diamagnetic member levitated relative to permanent magnets.
Figure 5:
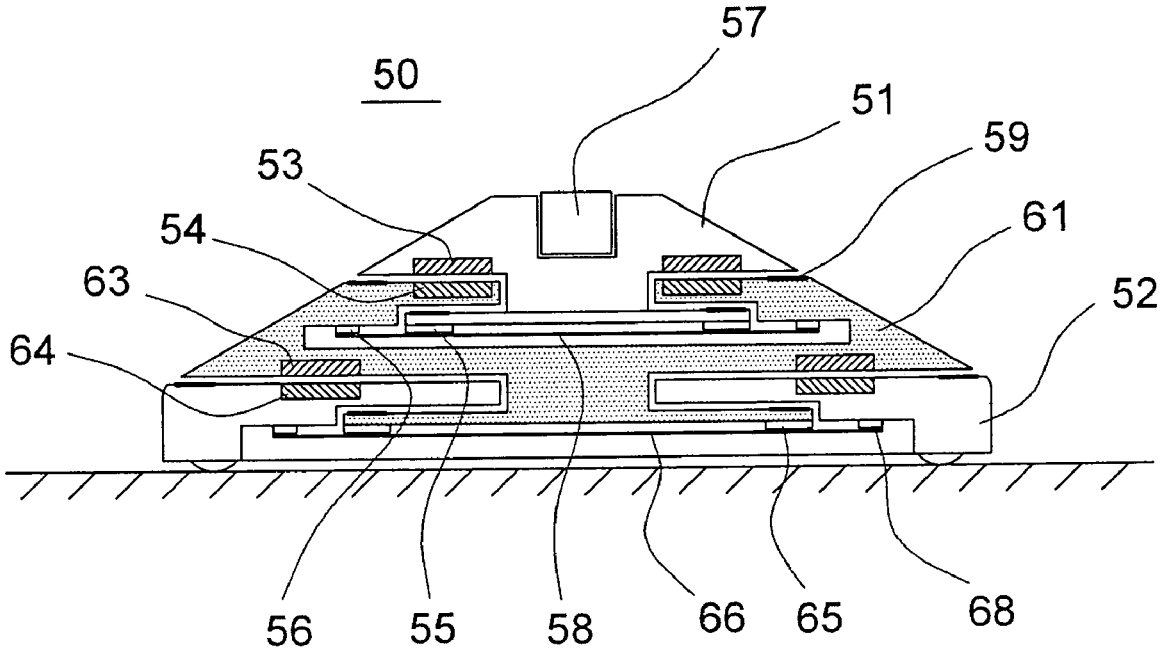
FIG. 5 shows a side view of a magnetic multi layer version of the preferred embodiment of the present invention.

The preferred embodiment of the present invention is shown in FIGS. 1*a* and 1*b*. Three alternative embodiments are shown in FIG. 3, FIG. 4 and FIG. 5, respectively. The figures show cross sectional views seen from the side and all of the discussed arrangements have a circular shape. The circular shape has some advantages when it comes to the distribution of the magnetic fields, however, in this description this is done only to simplify the drawings and to make them more readily understandable. Hence, the magnet can have any shape and be of any kind, permanent or electromagnetic type. FIGS. 2*a*-2*c* show three possible configurations for the magnets 21, 22, 23 used in the preferred embodiment of the present invention.

In FIGS. 1*a* and 1*b*, a microphone 10 for use on a table or a desk is shown. The microphone comprises two main parts, a substantially heavy top part 11 levitated above a base 12 placed on the table. The top part holds a circular magnet 13 with one of its poles (e.g., the North Pole) facing downwards. The magnet 13 is placed directly above another magnet 14 on the base. The magnet 14 on the base has the same pole (e.g., the North Pole) facing upward. Similar magnetic poles facing each other create a repelling force that levitates the top part of the microphone 11. In order to stabilize the magnets relative to each other, the top part is fixed sideways through small gimbals or flexible pads 15 and 18 and thin flexible arms/fingers 16. These arms do not restrict vertical movements; hence, one vertically oriented vibration can be transmitted to the top part. Because of the inherent weight of the top part and the low connection point 15 and 18 any horizontal oriented vibrations would cause the top part to tilt rather than move sideways, keeping the centre of the top part substantially still. Finally, the top part holds the microphone element 17 picking up the sound without the influence of any vibrations from the table.

To protect the top part of the microphone from being destroyed by extensive handling forces and to allow it to be turned up-side-down (e.g., during handling), the top part needs to be secured to the base by some mechanical structure holding it in place without any mechanical contact during normal operation. In FIGS. 1*a* and 1*b* it can be seen that the lower part of the top 11 has a geometry that allows it to move slightly with respect to the base 12 but prevents large displacements. Some kind of damping material 19 may also be applied between the two parts in order to prevent high sound to be generated if someone intentionally presses the top part down until it comes in contact with the base.

Each set of magnets may be composed of a circular magnet as in FIG. 2*c*, or of several smaller magnets as in FIGS. 2*a* and 2*b*.

A Second Preferred Embodiment of the Invention

In FIG. 3, an alternative arrangement 30 is shown. This is basically the same idea; however, this version might be better suited for building into a cabinet i.e. a loud speaking phone. All the features described in the first embodiments, the mechanical protection, i.e. the damping material, a safety bolt/hook or a retention bolt may be comprised in the second embodiment.

The arrangement 30 comprises two main parts, a top part 31 levitated above a base 32. In this arrangement the top part 31, the microphone 37 and the magnets 33 and 34 are tilted slightly with respect to the horizontal plane. This makes it possible for the thin flexible arms/fingers 35 to be attached only to one side of the top part, allowing for a simpler and more low cost mechanical design and possibly also smaller/simpler magnets.

A Third Preferred Embodiment of the Invention

In FIG. 4, yet another arrangement 40 is shown. Here the top part 41 holding the microphone element 47 is purely sustained and stabilized by magnetic forces. A circular diamagnetic member 45 is levitated relative to a permanent magnet 46 in the base 42; creating a magnetic field through a circular iron return member 44 and an iron pole plate 43. The features described in the previous embodiments regarding mechanical protection may be comprised in this third embodiment of the invention.

A Fourth Preferred Embodiment of the Invention

In FIG. 5, a multilayer structure 50 is disclosed, where one first part 51 constituting a signalling source 57 and magnets 53, either permanent magnets or not, is levitated on a second part 61 forming a base. The magnets 53 are placed directly above magnets 54 of the second part. These two parts 51, 61 combine to form a first signalling source device. The signalling source device may have magnets 63 fixed to its bottom. The second part 61 may further include damping material 59, gimbals or flexible pads 55, 56 and flexible arms/fingers 58. Further, a third part forms a second base 52 where the second base has magnets 64 on its top side arranged as to repel the first signalling device, hence providing a two layered feedback suppression system of magnetic levitation type. The third part may further include gimbals or flexible pads 65, 68 and flexible arms/fingers 66.

Using the same principle it is possible to build an n-layer structure. This fourth embodiment may be combined with any of the foregoing embodiments; further it may include all the features of the previous embodiments, such as the mechanical protection systems.

The main advantages of the invention compared to prior art is that the over-all performance of the microphone is increased, giving better quality sound and increased ability to pick up low level signals from, e.g., a person placed far away from the microphone. This is achieved by enabling the microphone to have a very "soft" connection to the surrounding structure generally through magnetic forces. This gives the microphone a natural swinging frequency that is much lower than otherwise possible, hence, mechanically isolating it from any system around it.

In equipment with both a microphone and a loudspeaker built in, where undesired acoustic and structural coupling between these are present and must be compensated for, the overall coupling, and in particular, the harmonic distortion of the coupling can be reduced, simplifying either (or both) the design of the echo canceller/compensator or the overall mechanical design.

The invention may also be combined with techniques presented in prior art. For example, by reducing vibration pickup from one direction by proper orientation of the microphone membrane, a simplified magnet arrangement can be used, which only need to reduce vibrations normally to the membrane.

While this invention has been particularly shown and described with references to preferred embodiments thereof, it will be understood by those skilled in the art that various changes in form and details may be made therein without departing from the scope of the invention encompassed by the appended claims.

What is claimed is:

1. A sound recording or sound reproducing part loosely anchored/connected to a second part, wherein the sound recording or sound reproducing part is levitated by a magnetic field.

2. A sound recording or sound reproducing part according to claim 1, wherein the sound recording or sound reproducing part and the second part in combination forms a first sound recording or sound reproducing device.

3. A sound recording or sound reproducing part according to claim 2, wherein the first sound recording or sound reproducing device is an integral part of one or more of the following devices:

a loud speaking telephone, a telephone, wireless communication equipment, a mobile phone, a Bluetooth device, a videoconference terminal, a hearing aid and active ear protecting equipment.

4. A sound recording or sound reproducing part according to claim 2, wherein the first sound recording or sound reproducing device forms a first layer, in a number of layers wherein each layer is levitated on a magnetic field between an upper and a lower layer.

5. A sound recording or sound reproducing part according to claim 4, wherein the first sound recording or sound reproducing device is fixed sideways through gimbals, flexible pads, or flexible arms/fingers.

6. A sound recording or sound reproducing part according to claim 5, wherein the sideways fixing arrangement comprises one or more arms/fingers stretching out from the first sound recording or sound reproducing device and the fixing arrangement is/are fixed to the lower layer.

7. A sound recording or sound reproducing part according to claim 6, wherein the arms/fingers allow the first sound recording or sound reproducing device to move freely along an axis parallel to the magnetic flux lines between each layer.

8. A sound recording or sound reproducing part according to claim 4, wherein a damping material/substrate is attached to one or both of the surfaces between the first sound recording or sound reproducing device and the lower layer.

9. A sound recording or sound reproducing part according to claim 2, wherein the first recording or sound reproducing device is a tabletop microphone.

10. The use of a sound recording or sound reproducing part according to claim 2, wherein said first sound recording or sound reproducing device can be used as an integral part in one or more of the following devices:

a loud speaking telephone, a telephone, a wireless communication equipment, a mobile phone, a Bluetooth device, a videoconference terminal, a hearing aid and active ear protecting equipment.

11. A sound recording or sound reproducing part according to claim 1, wherein the magnetic field is achieved due to a permanent magnet or an electromagnet held by the sound recording or sound reproducing part and a magnet held by the second part, where the magnets have the same poles facing each other creating a repellent force which causes the sound recording or sound reproducing part to levitate.

12. A sound recording or sound reproducing part according to claim 1, wherein the recording or sound reproducing part is fixed sideways through gimbals, flexible pads, or flexible arms/fingers.

13. A sound recording or sound reproducing part according to claim 12, wherein the sideway fixing arrangement comprises one or more arms/fingers stretching out from the sound recording or sound reproducing part and the fixing arrangement is/are fixed to the second part.

14. A sound recording or sound reproducing part according to claim 13, wherein the arms/fingers allow the sound recording or sound reproducing part to move freely along an axis parallel to the magnetic flux lines.

15. A sound recording or sound reproducing part according to claim 1, wherein the sound recording or sound reproducing part is mechanically secured against mechanically interference.

16. A sound recording or sound reproducing part according to claim 15, wherein the mechanical securing arrangement includes a safety bolt or a safety hook retention bolt.

17. A sound recording or sound reproducing part according to claim 1, wherein a damping material/substrate is attached to one or both of the surfaces between the sound recording or sound reproducing part and the second part.

18. A sound recording or sound reproducing part according to claim 1, wherein the sound recording or sound reproducing part holds a microphone.

19. A sound recording or sound reproducing part according to claim 1, wherein the sound recording or sound reproducing part holds a speaker element.

20. A sound recording or sound reproducing part according to claim 1, wherein signal or power transmission between the sound recording or the sound reproducing part and the second part comprises wireless transmission.

21. A sound recording or sound reproducing part according to claim 20, wherein the wireless transmission comprises one or more of the following:

a Bluetooth connection/transmission, a radio connection different from the Bluetooth connection, ultraviolet connection/transmission, a magnetic connection/transmission, an optical connection/transmission and an inductively coupled system.

* * * * *